US008722748B2

(12) United States Patent
Tasaka

(10) Patent No.: US 8,722,748 B2
(45) Date of Patent: May 13, 2014

(54) PROCESS FOR PRODUCING HYDROCARBONS

(75) Inventor: Kazuhiko Tasaka, Tokyo (JP)

(73) Assignees: Japan Oil, Gas and Metals National Corporation, Tokyo (JP); Inpex Corporation, Tokyo (JP); JX Nippon Oil & Energy Corporation, Tokyo (JP); Japan Petroleum Exploration Co., Ltd., Tokyo (JP); Cosmo Oil Co., Ltd., Tokyo (JP); Nippon Steel Engineering Co., Ltd., Tokyo (JP)

( * ) Notice: Subject to any disclaimer, the term of this patent is extended or adjusted under 35 U.S.C. 154(b) by 0 days.

(21) Appl. No.: 13/637,163

(22) PCT Filed: Mar. 15, 2011

(86) PCT No.: PCT/JP2011/056032

§ 371 (c)(1),
(2), (4) Date: Sep. 25, 2012

(87) PCT Pub. No.: WO2011/122329

PCT Pub. Date: Oct. 6, 2011

(65) Prior Publication Data

US 2013/0018113 A1 Jan. 17, 2013

(30) Foreign Application Priority Data

Mar. 30, 2010 (JP) ..... 2010-079551

(51) Int. Cl.
*C07C 27/00* (2006.01)

(52) U.S. Cl.
USPC ..... 518/700; 518/728

(58) Field of Classification Search
USPC ..... 518/700, 728
See application file for complete search history.

(56) References Cited

U.S. PATENT DOCUMENTS

| | | | |
|---|---|---|---|
| 6,822,006 | B1 | 11/2004 | O'Rear et al. |
| 2007/0014703 | A1 | 1/2007 | Schweitzer et al. |

FOREIGN PATENT DOCUMENTS

| | | |
|---|---|---|
| AU | 2009-224342 | 9/2009 |
| CN | 1304913 | 7/2001 |
| CN | 101475427 | 7/2009 |
| KR | 10-2010-0006211 | 1/2010 |
| WO | WO2009-107927 | 9/2009 |
| WO | WO2009-113613 | 9/2009 |
| WO | WO 2009/123095 | 10/2009 |

OTHER PUBLICATIONS

International Search Report dated Apr. 19, 2011 issued in corresponding PCT Application No. PCT/JP2011/056032.

Yasuhiro Onishi, et al., "Transition and the future of the GTL technology development" Nippon Steel Engineering Co., Ltd. Technical Review, Jan. 2010, vol. 01, pp. 29 to 38 [partial English Translation].

Search Report dated Feb. 18, 2014 issued in corresponding EP Application No. 11762569.9.

Office Action dated Dec. 26, 2013 issued in corresponding CN Application No. 201180016606.9 [With English Translation of Search Report].

*Primary Examiner* — Jafar Parsa
(74) *Attorney, Agent, or Firm* — Kenyon & Kenyon LLP

(57) ABSTRACT

In a process for producing hydrocarbons according to the present invention, estimated production rates for a light hydrocarbon oil and a heavy hydrocarbon oil are respectively determined based on a set reaction temperature used when the hydrocarbons are synthesized by a Fischer-Tropsch synthesis reaction, and the discharge flow rates of the light hydrocarbon oil and the heavy hydrocarbon oil from temporary storage buffer tanks (91, 92) during supply to a fractionator (40) are respectively controlled so as to be equal to the respective estimated production rates.

3 Claims, 2 Drawing Sheets

PROCESS FOR PRODUCING HYDROCARBONS

TECHNICAL FIELD

The present invention relates to a process for producing hydrocarbons by synthesizing hydrocarbons from hydrogen gas and carbon monoxide gas in the presence of a catalyst, and then fractionally distilling the obtained hydrocarbons.

This application is a national stage application of International Application No. PCT/JP2011/056032, filed Mar. 15, 2011, which claims priority to Japanese Patent Application No. 2010-79551, filed Mar. 30, 2010, the content of which is incorporated herein by reference.

BACKGROUND ART

As a process for producing hydrocarbons that can be used as feedstocks for liquid fuel products such as naphtha (raw gasoline), kerosene and gas oil, a process that employs a Fischer-Tropsch synthesis reaction (hereinafter also abbreviated as "FT synthesis reaction") which uses a synthesis gas containing mainly carbon monoxide gas (CO) and hydrogen gas ($H_2$) as a feedstock is already known.

In terms of the synthesis reaction system used for synthesizing the hydrocarbons via the FT synthesis reaction, a bubble column slurry bed FT synthesis reaction system in which the FT synthesis reaction is conducted inside a reactor, by blowing the synthesis gas through a slurry prepared by suspending catalyst particles within liquid hydrocarbons has already been disclosed (see Patent Document 1).

In a typical FT synthesis reaction, during a gas-liquid separation step that is provided either as part of the reaction step or following the reaction step, a gas-liquid separation is performed that yields a liquid phase composed of the liquid reaction products and a gas phase containing an unreacted synthesis gas (hydrogen gas and carbon monoxide gas). This gas-liquid separation step is generally conducted at a comparatively high temperature in order to maintain the fluidity of the wax fraction contained within the reaction product, and therefore the gas phase tends to contain not only the unreacted synthesis gas, but also those light hydrocarbons among the FT synthesis reaction products that have a relatively low boiling point. On the other hand, the liquid phase is composed of a heavy hydrocarbon oil having a relatively high boiling point. The separated gas phase is then cooled, and a second gas-liquid separation is performed, yielding liquid hydrocarbons (a light hydrocarbon oil) and a gas containing mainly hydrocarbons that are gases at normal temperatures (typically hydrocarbons having a carbon number of 4 or less) and the unreacted synthesis gas.

The thus obtained light hydrocarbon oil and heavy hydrocarbon oil are stored temporarily in separate buffer tanks, and the light hydrocarbon oil and the heavy hydrocarbon oil are then discharged from the respective buffer tanks, mixed together, and then supplied, for example, to a multi-stage fractionator fitted with trays.

In the fractionator, the mixed oil containing the light hydrocarbon oil and the heavy hydrocarbon oil is fractionally distilled into, for example, a naphtha fraction that is discharged from the top of the fractionator, a middle distillate that is discharged from the central section of the fractionator, and a wax fraction that is discharged from the bottom of the fractionator. Each of these fractions passes through an upgrading step in which the fraction is subjected to hydroprocessing and fractional distillation, thus forming various liquid fuel base stocks.

CITATION LIST

Patent Document

[Patent Document 1] United States Patent Application, Publication No. 2007/0014703

SUMMARY OF INVENTION

Technical Problem

However, in an FT synthesis reaction using, for example, the type of bubble column slurry bed FT synthesis reaction system mentioned above, the reaction temperature may temporarily diverge from the set value, and the height of the slurry liquid surface may temporarily fluctuate. This type of temporary divergence in the reaction temperature from the set value or fluctuation in the height of the slurry liquid surface during the FT synthesis reaction has an effect on the flow rates of the light hydrocarbon oil and the heavy hydrocarbon oil into the respective buffer tanks.

In a conventional FT synthesis reaction system, the discharge flow rates of the light hydrocarbon oil and the heavy hydrocarbon oil from the respective buffer tanks are adjusted so that the height of the liquid level within each of the buffer tanks remains constant even if the flow rate of the light hydrocarbon oil and the heavy hydrocarbon oil into the buffer tanks fluctuates. However, if the discharge flow rates are adjusted in this manner, then the ratio between the light hydrocarbon oil and the heavy hydrocarbon oil supplied to the fractionator and the combined flow rate of the supplied hydrocarbon oils tend to be prone to fluctuation.

In order to ensure the supply of high-quality feedstock fractions to the subsequent upgrading step, it is necessary to maintain the distillation cutoff for each fraction in the fractionator at a constant level, that is, the discharge tray temperature of the fractionator for each fraction must be maintained at a constant temperature. However, if the ratio between the light hydrocarbon oil and the heavy hydrocarbon oil fluctuates at the fractionator inlet, then although the discharge tray temperatures can usually be maintained at constant temperatures by altering the amount of each fraction discharged from the fractionator, sometimes it is impossible to completely compensate for the fluctuations. As a result, ensuring a constant composition for each of the discharged fractions has proven difficult.

The present invention has been developed in light of the above circumstances, and has an object of providing a process for producing hydrocarbons, which is capable of suppressing fluctuations in the ratio between, and the flow rates of, the light hydrocarbon oil and the heavy hydrocarbon oil supplied to the fractionator that can occur when the reaction temperature temporarily diverges from the set value or the height of the slurry liquid surface fluctuates during the FT synthesis reaction.

Solution to Problem

The inventors of the present invention postulated that instead of using the conventional process in which the heights of the respective liquid surfaces within the buffer tanks used for temporarily storing the light hydrocarbon oil and the heavy hydrocarbon oil are maintained at a constant height, but rather setting the discharge flow rates of the light hydrocarbon oil and the heavy hydrocarbon oil from the respective buffer tanks to predetermined values respectively, and then balancing the production of the light hydrocarbon oil and heavy hydrocarbon oil from the FT synthesis reaction with these discharge values, the influences of the above-mentioned temporary fluctuations could be eliminated, enabling a stable supply of the mixed oil to the fractionator, and they were therefore able to complete the present invention.

In other words, a process for producing hydrocarbons according to the present invention includes: a synthesis step of synthesizing hydrocarbons from continuously supplied hydrogen gas and carbon monoxide gas by a Fischer-Tropsch synthesis reaction in the presence of a catalyst, a gas-liquid separation step of separating the hydrocarbons into light hydrocarbons and a heavy hydrocarbon oil by gas-liquid separation, a temporary storage step of continuously supplying a light hydrocarbon oil obtained from the light hydrocarbons and the heavy hydrocarbon oil to respective buffer tanks, a discharge step of continuously discharging the light hydrocarbon oil and the heavy hydrocarbon oil from the respective buffer tanks, mixing the light hydrocarbon oil and the heavy hydrocarbon oil, and supplying the resulting mixed oil to a fractionator, and a fractional distillation step of fractionally distilling the mixed oil of the light hydrocarbon oil and the heavy hydrocarbon oil into at least a wax fraction and a fraction that is lighter than the wax fraction.

In the process for producing hydrocarbons according to the present invention, estimated production rates for the light hydrocarbon oil and the heavy hydrocarbon oil are respectively determined based on the set reaction temperature in the synthesis step, and the discharge flow rates for the light hydrocarbon oil and the heavy hydrocarbon oil in the discharge step are respectively controlled so as to be equal to the respective estimated production rates.

In the process for producing hydrocarbons according to the present invention, the synthesis step and the gas-liquid separation step may be performed inside a slurry bed reactor having a gas phase portion within the upper section of the reactor.

Further, the estimated production rates for the light hydrocarbon oil and the heavy hydrocarbon oil may be respectively determined on the basis of the relationship between the reaction temperature of the Fischer-Tropsch synthesis reaction and the chain growth probability for the catalyst used in the synthesis step.

Advantageous Effects of Invention

The process for producing hydrocarbons of the present invention is capable of suppressing fluctuations in the ratio between, and the combined flow rate of, the light hydrocarbon oil and the heavy hydrocarbon oil supplied to the fractionator that can occur when the reaction temperature temporarily diverges from the set value or the height of the slurry liquid surface inside the slurry bed reactor fluctuates during the FT synthesis reaction, thus enabling the operation of the fractionator to be stabilized.

DESCRIPTION OF EMBODIMENTS (Liquid Fuel Production System)

First is a description of an example of a liquid fuel production system in which the process for producing hydrocarbons according to the present invention may be used.

Figure 1:
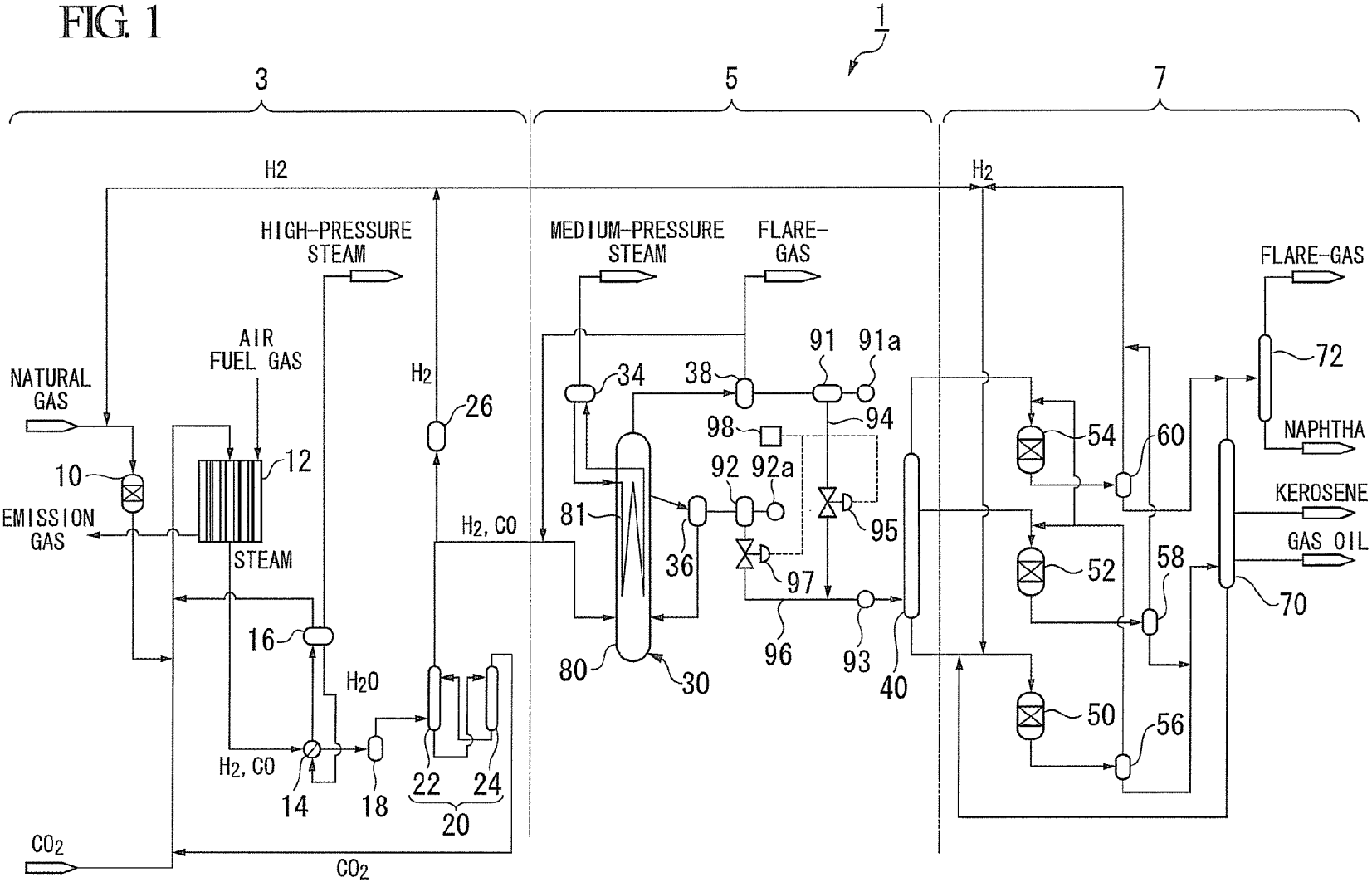
FIG. 1 is a schematic diagram illustrating the overall configuration of one example of a liquid fuel production system that utilizes a FT synthesis reaction.

FIG. 1 illustrates one example of a liquid fuel production system.

This liquid fuel production system 1 includes a synthesis gas production unit 3, an FT synthesis unit 5, and an upgrading unit 7. In the synthesis gas production unit 3, a natural gas that functions as a hydrocarbon feedstock is reformed to produce a synthesis gas containing carbon monoxide gas and hydrogen gas. In the FT synthesis unit 5, hydrocarbons are synthesized by an FT synthesis reaction from the synthesis gas produced by the synthesis gas production unit 3. This example shows a configuration in which a bubble column slurry bed FT synthesis reactor is used as the FT synthesis reactor. In the upgrading unit 7, the hydrocarbons synthesized in the FT synthesis unit 5 are hydroprocessed and fractionally distilled to produce base stocks for liquid fuels (such as naphtha, kerosene and gas oil) and a wax and the like.

The synthesis gas production unit 3 is composed mainly of a desulfurizer 10, a reformer 12, a waste heat boiler 14, gas-liquid separators 16 and 18, a $CO_2$ removal unit 20, and a hydrogen separator 26.

The desulfurizer 10 includes a hydrodesulfurization reactor or the like, and removes sulfur compounds from the natural gas that functions as the feedstock.

In the reformer 12, the natural gas supplied from the desulfurizer 10 is reformed, for example by a steam-carbon dioxide reforming process, to produce a synthesis gas containing carbon monoxide gas (CO) and hydrogen gas ($H_2$) as the main components.

In the waste heat boiler 14, waste heat from the synthesis gas produced in the reformer 12 is recovered to generate a high-pressure steam.

In the gas-liquid separator 16, the water that has been heated by heat exchange with the high-temperature synthesis gas in the waste heat boiler 14 is separated into a gas (high-pressure steam) and liquid water.

In the gas-liquid separator 18, a condensed component is removed from the synthesis gas that has been cooled in the waste heat boiler 14, while the gas component is supplied to the $CO_2$ removal unit 20.

The $CO_2$ removal unit 20 has an absorption tower 22 that uses an absorbent to remove carbon dioxide gas from the synthesis gas supplied from the gas-liquid separator 18, and a regeneration tower 24 that releases the carbon dioxide gas absorbed by the absorbent, thereby regenerating the absorbent.

In the hydrogen separator 26, a portion of the hydrogen gas is separated from the synthesis gas from which the carbon dioxide gas has already been separated by the $CO_2$ removal unit 20.

The FT synthesis unit 5 includes mainly a FT synthesis reactor 30 composed of a bubble column slurry bed reactor, a gas-liquid separator 34, a catalyst separator 36, a gas-liquid separator 38, and a first fractionator 40.

The FT synthesis reactor 30 is a reactor that synthesizes liquid hydrocarbons from the synthesis gas by the FT synthesis reaction, and is composed mainly of a reactor main unit 80 and a cooling tube 81.

The reactor main unit 80 is a substantially cylindrical metal vessel, the inside of which contains slurry prepared by suspending solid catalyst particles within liquid hydrocarbons (the FT synthesis reaction product).

The synthesis gas containing hydrogen gas and carbon monoxide gas as the main components is injected into the slurry from a position in the bottom section of the reactor main unit 80. This synthesis gas that has been injected into the slurry forms bubbles that rise up through the slurry along the vertical direction of the reactor main unit 80 from bottom to top. During this process, the synthesis gas dissolves in the liquid hydrocarbons and makes contact with the catalyst particles, causing the hydrocarbon synthesis reaction (the FT synthesis reaction) to proceed.

Further, as the synthesis gas rises up through the inside of the reactor main unit 80 in the form of gas bubbles, an upward flow (air lift) is generated within the slurry inside the reactor main unit 80. As a result, a circulating flow is generated within the slurry inside the reactor main unit 80. The unreacted synthesis gas and those hydrocarbons generated by the FT synthesis reaction that exist as gas under the conditions inside the reactor main unit 80 reaching the top of the reactor main unit 80, are discharged from the top of the reactor main unit 80. In this description, the hydrocarbons that exist as gas under the conditions inside the reactor main unit 80 are termed "light hydrocarbons."

In the gas-liquid separator 34, the water that has been heated by passage through the cooling tube 81 provided inside the FT synthesis reactor 30 is separated into a steam (medium-pressure steam) and liquid water.

The unreacted synthesis gas and light hydrocarbons discharged from the top of the FT synthesis reactor 30 are introduced into the gas-liquid separator 38 and cooled. Moreover, the condensed liquid component produced as a result of the cooling is then separated from the gaseous component composed of the unreacted synthesis gas and a hydrocarbon gas composed mainly of hydrocarbons having a carbon number of 4 or less. In this description, this liquid component is described as a "light hydrocarbon oil." In this example, the light hydrocarbon oil is composed mainly of hydrocarbons equivalent to a naphtha fraction and a middle distillate.

In the catalyst separator 36, the slurry discharged from the middle section of the FT synthesis reactor 30 is separated into catalyst particles and a liquid hydrocarbon product. In this description, the liquid hydrocarbon product obtained from the separator 36 is described as a "heavy hydrocarbon oil." This heavy hydrocarbon oil is composed of hydrocarbons that are heavier than the light hydrocarbons.

In the first fractionator 40, a mixed oil resulting from the mixing of the heavy hydrocarbon oil supplied from the FT synthesis reactor 30 via the catalyst separator 36, and the light hydrocarbon oil supplied via the gas-liquid separator 38 is subjected to fractional distillation, and is separated into a number of fractions (a naphtha fraction, a middle distillate, and a wax fraction) according to boiling points. The naphtha fraction is the fraction of hydrocarbons for which the boiling point is lower than approximately 150° C., the middle distillate is the fraction containing hydrocarbons having a boiling point of 150 to 360° C., and the wax fraction is the fraction containing components having a boiling point that exceeds approximately 360° C.

Further, the FT synthesis unit 5 also includes a first buffer tank 91 in which the light hydrocarbon oil discharged from the gas-liquid separator 38 is stored temporarily, a second buffer tank 92 in which the heavy hydrocarbon oil discharged from the catalyst separator 36 is stored temporarily, and a heater 93 that is used for heating the mixed oil supplied to the first fractionator 40.

Furthermore, a second flow rate regulating valve 97 is fitted in a line 96 connecting the second buffer tank 92 and the heater 93, and a first flow rate regulating valve 95 is fitted in a line 94 connecting the first buffer tank 91 and the line 96.

Moreover, the FT synthesis unit 5 is also equipped with a control unit 98, into which is input a set value for the reaction temperature for the FT synthesis reaction, and which adjusts the degree of opening of the first flow rate regulating valve 95 and the second flow rate regulating valve 97 on the basis of this temperature setting information.

Level gauges 91*a* and 92*a* are installed in the first buffer tank 91 and the second buffer tank 92 respectively for measuring the height of the liquid surface within the tank. As these level gauges 91*a* and 92*a*, magnetic level gauges or the like can be used.

The upgrading unit 7 includes mainly a wax fraction hydrocracking reactor 50, a middle distillate hydrotreating reactor 52, a naphtha fraction hydrotreating reactor 54, gas-liquid separators 56, 58 and 60, a second fractionator 70, and a naphtha stabilizer 72.

The wax fraction hydrocracking reactor 50 is connected to the bottom of the first fractionator 40, and is supplied with the wax fraction.

The middle distillate hydrotreating reactor 52 is connected to a middle section of the first fractionator 40, and is supplied with the middle distillate.

The naphtha fraction hydrotreating reactor 54 is connected to the top of the first fractionator 40, and is supplied with the naphtha fraction.

The gas-liquid separators 56, 58 and 60 are provided in corresponding positions downstream from the reactors 50, 52 and 54 respectively.

In the second fractionator 70, the liquid hydrocarbons supplied from the gas-liquid separators 56 and 58 are fractionally distilled according to their boiling points.

The naphtha stabilizer 72 fractionally distills the liquid hydrocarbons contained within the naphtha fraction supplied from the gas-liquid separator 60 and the second fractionator 70, and the resulting gas component having a carbon number of 4 or less is discharged as a flare gas, while the components having a carbon number of 5 or greater are recovered as a naphtha product.

(Process for Producing Hydrocarbons)

A description of an embodiment of the process for producing hydrocarbons according to the present invention, which uses mainly the FT synthesis unit that constitutes part of the liquid fuel production system 1 described above is presented below.

In this embodiment, a natural gas containing methane as the main component is supplied to the synthesis gas production unit 3, and is reformed to produce a synthesis gas (a mixed gas containing carbon monoxide gas and hydrogen gas as the main components).

Specifically, first, the natural gas described above is supplied to the desulfurizer 10 together with the hydrogen gas separated by the hydrogen separator 26. The desulfurizer 10 includes a hydrodesulfurization reactor and a subsequent hydrogen sulfide adsorption unit. In the hydrodesulfurization reactor, which is filled with a conventional hydrodesulfurization catalyst, sulfur compounds contained within the natural gas are hydrogenated and converted to hydrogen sulfide. This hydrogen sulfide is adsorbed and removed by the hydrogen sulfide adsorption device, which is positioned downstream from the hydrodesulfurization reactor. By subjecting the natural gas to a desulfurization in this manner, any reduction in the activity of the catalysts used in the reformer 12 and the FT synthesis reactor 30 and the like caused by sulfur compounds can be prevented.

The natural gas (which may also include carbon dioxide gas) that has been desulfurized in this manner is supplied to the reformer 12 after mixing with carbon dioxide gas ($CO_2$) supplied from a carbon dioxide supply source (not shown in the drawing) and the steam generated in the waste heat boiler 14. In the reformer 12, the natural gas is reformed, for example by a steam-carbon dioxide reforming process using the steam and carbon dioxide gas, thereby producing a high-temperature synthesis gas containing carbon monoxide gas and hydrogen gas as main components. At this time, a fuel gas and air for a burner installed in the reformer 12 are supplied to the reformer 12, and the combustion heat from the fuel gas in the burner and the radiant heat from the furnace of the reformer 12 are used to provide the necessary heat for the above steam-carbon dioxide gas reforming reaction, which is an endothermic reaction.

The high-temperature synthesis gas (for example, 900° C., 2.0 MPaG) produced in the reformer 12 in this manner is supplied to the waste heat boiler 14, and is cooled (for example, to 400° C.) by heat exchange with the water circulating through the waste heat boiler 14, thereby recovering the waste heat from the synthesis gas. At this time, the water heated by the synthesis gas in the waste heat boiler 14 is supplied to the gas-liquid separator 16. In the gas-liquid separator 16, the gaseous component of the water is supplied as high-pressure steam (for example, 3.4 to 10.0 MPaG) to the reformer 12 or other external devices, and the liquid water is returned to the waste heat boiler 14.

Meanwhile, the synthesis gas that has been cooled within the waste heat boiler 14 is supplied to either the absorption tower 22 of the $CO_2$ removal unit 20 or the FT synthesis reactor 30, after a condensed liquid fraction has been separated and removed from the synthesis gas in the gas-liquid separator 18. In the absorption tower 22, carbon dioxide gas contained in the synthesis gas is absorbed by an absorbent contained within the absorption tower 22, thereby removing the carbon dioxide gas from the synthesis gas. The absorbent that has absorbed the carbon dioxide gas within the absorption tower 22 is then introduced into the regeneration tower 24, where it is heated with steam or the like and subjected to a stripping treatment. The carbon dioxide gas thus removed from the absorbent is fed from the regeneration tower 24 to the reformer 12, where it is reused for the above reforming reaction.

The synthesis gas produced in the synthesis gas production unit 3 in this manner is supplied continuously to the FT synthesis reactor 30 of the above-mentioned FT synthesis unit 5. At this time, the composition ratio of the synthesis gas supplied to the FT synthesis reactor 30 is adjusted to a composition ratio suitable for the FT synthesis reaction (for example, $H_2$:CO=2:1 (molar ratio)). In addition, the synthesis gas supplied to the FT synthesis reactor 30 is pressurized to a pressure suitable for the FT synthesis reaction (for example, 3.6 MPaG) by a compressor (not shown in the drawing) provided in the line that connects the $CO_2$ removal unit 20 with the FT synthesis reactor 30. In some cases, this compressor may not be provided.

Furthermore, a portion of the synthesis gas that has undergone separation of the carbon dioxide gas by the above $CO_2$ removal unit 20 is also supplied to the hydrogen separator 26. In the hydrogen separator 26, a portion of the hydrogen gas contained in the synthesis gas is separated by hydrogen pressure swing adsorption (PSA) method. The separated hydrogen gas is supplied continuously from a gas holder or the like (not shown in the drawing) via a compressor (not shown in the drawing) to the various hydrogen-utilizing reactors (for example, the hydrodesulfurization reactor of the desulfurizer 10, the wax fraction hydrocracking reactor 50, the middle distillate hydrotreating reactor 52, and the naphtha fraction hydrotreating reactor 54) within the liquid fuel production system 1 that perform predetermined reactions using hydrogen gas.

Next, the FT synthesis unit 5 synthesizes hydrocarbons by the FT synthesis reaction from the synthesis gas produced by the above synthesis gas production unit 3. This synthesis method for these hydrocarbons is described below.

(Synthesis Step/Gas-Liquid Separation Step)

Specifically, the synthesis gas produced in the above-mentioned synthesis gas production unit 3 is introduced into the bottom of the reactor main unit 80 that constitutes the FT synthesis reactor 30, and rises up through the slurry contained within the reactor main unit 80. During this time within the reactor main unit 80, the carbon monoxide gas and hydrogen gas contained within the synthesis gas react with each other by the above FT synthesis reaction, and hydrocarbons are produced.

Moreover, during this synthesis reaction, the reaction heat of the FT synthesis reaction is removed by passing water through the cooling tube 81, and the water that has been heated by this heat exchange is vaporized into steam. This steam is supplied to the gas-liquid separator 34, and the liquefied water is returned to the cooling tube 81, while the gas fraction is supplied to an external device as a medium-pressure steam (for example, 1.0 to 2.5 MPaG).

A portion of the slurry containing the hydrocarbons and catalyst particles within the reactor main unit 80 FT of the synthesis reactor 30 is discharged from the middle section of the reactor main unit 80 and introduced continuously into the catalyst separator 36. In the catalyst separator 36, the introduced slurry is filtered through a filter to trap the catalyst particles. This filtering separates the slurry into a solid component and a heavy hydrocarbon oil (hydrocarbons having a carbon number of approximately 11 or higher) in a continuous manner, and the separated heavy hydrocarbon oil is fed continuously into the second buffer tank 92.

The filter of the catalyst separator 36 is subjected to backwashing as appropriate to remove the trapped particles from the filter surface and return those particles to the reactor main unit 80. At this time, the catalyst particles trapped by the filter are returned to the reactor main unit 80 together with a portion of the liquid hydrocarbons.

The reactor main unit 80 includes a gas phase portion above the slurry contained within the reactor. A mixture of unreacted synthesis gas that has risen up through the slurry, passed through the slurry liquid surface and entered the gas phase portion, and light hydrocarbons existing in a gaseous state under the conditions inside the reactor main unit 80 that have been generated by the reaction and entered the gas phase portion is discharged continuously from the top of the reactor main unit 80.

In other words, inside the reactor main unit 80, at the same time that the synthesis step is proceeding via the FT synthesis reaction, a gas-liquid separation step also occurs, yielding a heavy hydrocarbon oil, which is the liquid phase discharged as a slurry from the middle section of the reactor main unit 80, and a gas phase containing unreacted synthesis gas and light hydrocarbons, which is discharged from the top of the reactor main unit 80.

Although there are no particular limitations on the catalyst that constitutes part of the slurry inside the reactor main unit 80, catalysts containing an inorganic oxide support such as silica with an active metal such as cobalt supported thereon can be used favorably.

Further, although there are no particular limitations on the reaction conditions for the FT synthesis reaction inside the reactor main unit 80, selection of the types of reaction conditions listed below is preferable. Namely, from the viewpoints of achieving a favorable carbon monoxide conversion and increasing the carbon number of the produced hydrocarbons, the reaction temperature is preferably within a range from 150 to 300° C. For similar reasons, the reaction pressure is preferably within a range from 0.5 to 5.0 MPa. The ratio (molar ratio) of hydrogen gas/carbon monoxide gas within the feedstock gas is preferably within a range from 0.5 to 4.0. In terms of the hydrocarbon production efficiency, the carbon monoxide conversion is preferably not less than 50%.

(Temporary Storage Step)

The mixture containing light hydrocarbons and unreacted synthesis gas discharged from the top of the reactor main unit 80 is cooled in the gas-liquid separator 38, and the condensed light hydrocarbon oil (containing mainly hydrocarbons having a carbon number of 5 to 20) is supplied continuously to the first buffer tank 91. Meanwhile, the gas fraction separated by the gas-liquid separator 38, namely a mixed gas containing mainly unreacted synthesis gas (carbon monoxide gas and hydrogen gas) and hydrocarbon gas having a low carbon number (namely, a carbon number of 4 or less), is recycled back into the FT synthesis reactor 30, and the unreacted synthesis gas contained within the mixed gas is once again subjected to the FT synthesis reaction. In order to prevent an accumulation of a high concentration of gaseous hydrocarbons having a carbon number of 4 or less inside the FT synthesis reaction system as a result of the recycling of this mixed gas, a portion of the mixed gas is not recycled into the FT synthesis reactor 30, but is rather introduced into an external combustion facility (flare stack not shown in the drawing), where it is combusted and then released into the atmosphere.

(Discharge Step)

Subsequently, the light hydrocarbon oil is discharged from the first buffer tank 91, and the heavy hydrocarbon oil is discharged from the second buffer tank 92. The light hydrocarbon oil discharged from the first buffer tank 91 and the heavy hydrocarbon oil discharged from the second buffer tank 92 are mixed inside the line 96, and the resulting mixture is supplied continuously to the first fractionator 40.

During this process, the discharge flow rates of the light hydrocarbon oil from the first buffer tank 91 and the heavy hydrocarbon oil from the second buffer tank 92 are respectively controlled so as to be equal to the respective estimated production rates of the light hydrocarbon oil and the heavy hydrocarbon oil within the synthesis step, which are calculated on the basis of the set value for the reaction temperature for the FT synthesis reaction in the synthesis step. The calculation of the estimated production rates of the light hydrocarbon oil and the heavy hydrocarbon oil within the synthesis step is described below in detail.

By controlling the discharge flow rate from each of the buffer tanks in a constant manner, even if temporary fluctuations such as a divergence in the reaction temperature from the set value or a fluctuation in the height of the slurry liquid surface during the FT synthesis reaction cause temporary fluctuations of the height of the liquid surface within each buffer tank, the flow rates for the light hydrocarbon oil and the heavy hydrocarbon oil supplied to the first fractionator 40 remain constant, meaning the composition and flow rate of the mixed oil containing the light hydrocarbon oil and the heavy hydrocarbon oil that is supplied to the first fractionator 40 are stabilized.

Furthermore, by controlling the system so that the production rates for the light hydrocarbon oil and the heavy hydrocarbon oil in the synthesis step are equal to the discharge flow rates of the light hydrocarbon oil discharged from the first buffer tank 91 and the heavy hydrocarbon oil discharged from the second buffer tank 92 respectively, even if temporary fluctuations such as a divergence in the reaction temperature from the set value or a fluctuation in the height of the slurry liquid surface during the synthesis step cause temporary fluctuations in the height of the liquid surface within each buffer tank, when viewed over a longer period, the inflow and discharge rates for each buffer tank are balanced, meaning the height of the liquid surface within each buffer tank tends to stabilize.

In order to ensure that the discharge flow rates for the light hydrocarbon oil from the first buffer tank 91 and the heavy hydrocarbon oil from the second buffer tank 92 are equal to the corresponding respective estimated production rates for the light hydrocarbon oil and the heavy hydrocarbon oil in the synthesis step, the degree of opening of the first flow rate regulating valve 95 and the second flow rate regulating valve 97 are adjusted, thereby controlling the discharge flow rates of the light hydrocarbon oil from the first buffer tank 91 and the heavy hydrocarbon oil from the second buffer tank 92.

In the FT synthesis unit 3, the set value for the FT synthesis reaction temperature is input into the control unit 98, and based on this input set value for the reaction temperature, the control unit 98 calculates the respective degrees of opening required for the first flow rate regulating valve 95 and the second flow rate regulating valve 97, and then outputs command signals that specify these calculated degrees of opening to the first flow rate regulating valve 95 and the second flow rate regulating valve 97. Accordingly, by including the control unit 98 in this manner, the first flow rate regulating valve 95 and the second flow rate regulating valve 97 can be adjusted automatically in accordance with the set value for the reaction temperature of the FT synthesis reaction.

During the flow rate adjustments described above, if the height of the liquid surface inside the first buffer tank 91 and/or the second buffer tank 92 exceeds the upper limit or falls below the lower limit of a predetermined range, then the first flow rate regulating valve 95 and/or the second flow rate regulating valve 97 is adjusted to bring the height of the liquid surface back within the predetermined range. Alternatively, the conditions within the synthesis step may be altered accordingly.

A description of the method used for estimating the production rates of the light hydrocarbon oil and the heavy hydrocarbon oil within the FT synthesis reaction on the basis of the set value for the reaction temperature for the FT synthesis reaction is described below.

In the FT synthesis reaction, the chain growth probability changes mainly in accordance with the catalyst used and the reaction temperature. The chain growth probability is a parameter that indicates the probability of a methylene chain growing, and is described, for example, by Yasuhiro Onishi et al. in "Transition and the future of the GTL technology development", Nippon Steel Engineering Co., Ltd. Technical Review, Vol. 01 (2010). A larger chain growth probability results in an increase in the carbon number of the produced hydrocarbons. Further, this value can be used to estimate the carbon number distribution for the produced hydrocarbons. In other words, the carbon number distribution for the produced hydrocarbons may be assumed to follow the Anderson-Schulz-Flory distribution represented by the formula below.

$$W_n=(1-\alpha)^2 n\alpha^{n-1}$$

In this formula, n represents the carbon number for the hydrocarbons produced by the FT synthesis reaction, $W_n$ represents the weight fraction of the hydrocarbon product having a carbon number of n, and α represents the chain growth probability.

As is disclosed in the publication mentioned above, the above formula can be used to create a diagram for estimating the carbon number distribution of the produced hydrocarbons for any particular chain growth probability value.

Accordingly, in those cases where a predetermined catalyst is used and the FT synthesis reaction is conducted at a predetermined reaction temperature, if the chain growth probability with that catalyst and at that reaction temperature can be determined, then the carbon number distribution of the produced hydrocarbons can be estimated.

Figure 2:
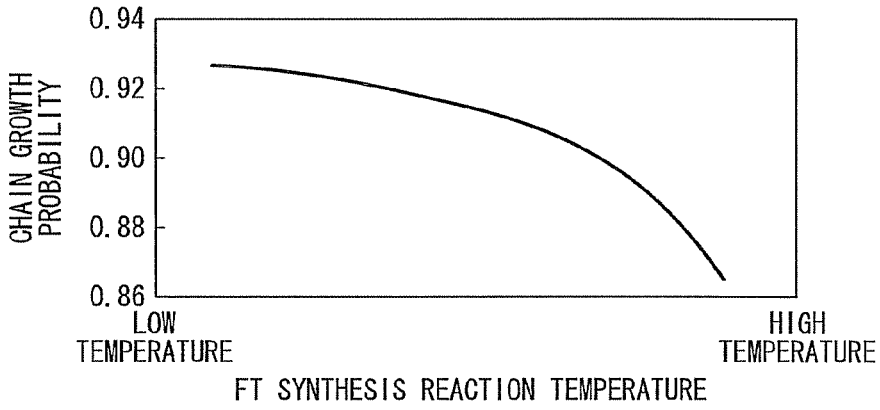
FIG. 2 is a graph illustrating an example of the approximate relationship of the chain growth probability relative to the reaction temperature within the FT synthesis reaction.

For the same catalyst, the chain growth probability tends to decrease with increasing reaction temperature, and thus the chain growth probability for a predetermined catalyst at any given reaction temperature can be ascertained in advance by analyzing the products obtained when the FT synthesis reaction operation is performed using the same catalyst but at various reaction temperatures (see the example in FIG. 2).

On the other hand, the range of carbon numbers for the hydrocarbons (light hydrocarbons) which are discharged from the top of the reactor main unit 80 and exist in a gaseous state under various reaction conditions inside the reactor main unit 80 can be ascertained either by an estimation based on the physical data of the various hydrocarbons produced in the FT synthesis reaction, or by another technique such as analyzing the results of previous operations. Accordingly, the range of carbon numbers for the hydrocarbons contained within the light hydrocarbon oil obtained under various different reaction conditions can be ascertained.

Provided the carbon number distribution of the hydrocarbons produced by the FT synthesis reaction at a specific reaction temperature, and the range of carbon numbers for the hydrocarbons contained within the light hydrocarbon oil obtained at that reaction temperature can be estimated, this information, together with data relating to the carbon monoxide conversion and the hydrocarbon selectivity in the reaction step can be used to estimate the production rate for the light hydrocarbon oil. Provided the production rate for the light hydrocarbon oil can be estimated, the production rate for the remaining heavy hydrocarbon oil can also be estimated.

Based on the values of the estimated production rates for the light hydrocarbon oil and the heavy hydrocarbon oil, which can be determined substantially unambiguously for the set value for the reaction temperature for the FT synthesis reaction in the manner described above, the above-mentioned control unit 98 controls the first flow rate regulating valve 95 and the second flow rate regulating valve 97 so that the discharge flow rates from the first buffer tank 91 and the second buffer tank 92 are equal to the production rates for the light hydrocarbon oil and the heavy hydrocarbon oil respectively.

Besides the estimation method based on the above-mentioned relationship between the reaction temperature of the FT synthesis reaction and the chain growth probability, estimation of the production rates for the light hydrocarbon oil and the heavy hydrocarbon oil in the synthesis step may also be made based on the actual results of past operations conducted under the same types of conditions (and particularly the same reaction temperature). For example, in those cases where actual results exist for a past operation which was able to be conducted with good stability, so that at a specific reaction temperature, no divergence in the reaction temperature from the set value nor fluctuation in the height of the slurry liquid surface occurred, and no significant fluctuations were observed in the discharge flow rates of the light hydrocarbon oil from the first buffer tank 91 and the heavy hydrocarbon oil from the second buffer tank 92, the respective discharge flow rates may be set so as to be equal to the respective discharge flow rates observed in the past operation.

(Fractional Distillation Step)

The mixed oil mentioned above is subjected to fractional distillation in the first fractionator 40, thereby separating the mixed oil into a naphtha fraction (the fraction for which the boiling point is lower than approximately 150° C.), a middle distillate (the fraction having a boiling point of approximately 150 to approximately 360° C.), and a wax fraction (the fraction having a boiling point that exceeds approximately 360° C.). This wax fraction (containing mainly hydrocarbons having a carbon number of 21 or more), which is discharged from the bottom of the first fractionator 40, is supplied to the wax fraction hydrocracking reactor 50, whereas the middle distillate (containing mainly hydrocarbons having a carbon number of 11 to 20) discharged from the middle section of the first fractionator 40 is supplied to the middle distillate hydrotreating reactor 52, and the liquid hydrocarbons (mainly having carbon number of 5 to 10) of the naphtha fraction discharged from the top of the first fractionator 40 are supplied to the naphtha fraction hydrotreating reactor 54.

(Upgrading Step)

An example of the upgrading step in which hydroprocessing and fractional distillation are used to produce liquid fuel base stocks from the hydrocarbons produced by the embodiment described above is described below.

Here, the term "hydroprocessing" refers to the hydrocracking of the wax fraction, hydrotreating of the middle distillate, and hydrotreating of the naphtha fraction.

In the wax fraction hydrocracking reactor 50, the wax fraction supplied from the bottom of the first fractionator 40 is subjected to hydrocracking using the hydrogen gas supplied from the above hydrogen separator 26 to reduce the carbon number to approximately 20 or less. In this hydrocracking reaction, carbon-carbon bonds of hydrocarbons with a large carbon number are cleaved, thereby producing lower molecular weight hydrocarbons with a smaller carbon number. A portion of normal paraffins mainly composing the wax fraction are hydroisomerized to generate isoparaffins, and unsaturated hydrocarbons contained within the wax fraction are hydrogenated to generate saturated hydrocarbons simultaneously. Further, oxygen-containing compounds such as alcohols contained within the wax fraction are hydrodeoxygenated to generate saturated hydrocarbons and water. A portion of the wax fraction is not hydrocracked to a desired degree, and discharged from the wax fraction hydrocracking reactor 50 together with the hydrocracked product as an uncracked was. The product produced by the hydrocracking within the wax fraction hydrocracking reactor 50 including the uncracked wax is separated into a gas component and a liquid component by the gas-liquid separator 56. The liquid component which is composed of liquid hydrocarbons is transferred into the second fractionator 70, whereas the gas component which contains hydrogen gas and gaseous hydrocarbons is supplied to the middle distillate hydrotreating reactor 52 and the naphtha fraction hydrotreating reactor 54 so that the hydrogen gas can be reused.

In the middle distillate hydrotreating reactor 52, the liquid hydrocarbons of the middle distillate having a mid-range carbon number that have been supplied from the middle section of the first fractionator 40 are hydrotreated using hydrogen gas supplied from the hydrogen separator 26 via the wax fraction hydrocracking reactor 50. During this hydrotreating, in order to obtain isoparaffins, mainly for the purpose of improving the low-temperature fluidity of the product for use as a base stock for fuel oils, the liquid hydrocarbons are subjected to hydroisomerization, and hydrogen is added to the unsaturated hydrocarbons contained within the liquid hydrocarbons to generate saturated hydrocarbons. Moreover, the oxygen-containing compounds such as alcohols contained within the hydrocarbons undergo hydrodeoxygenation and are converted to saturated hydrocarbons and water. The product including the hydrotreated liquid hydrocarbons is separated into a gas component and a liquid component in the gas-liquid separator 58. The separated liquid component which is composed of liquid hydrocarbons is transferred into the second fractionator 70, and the gas component which contains hydrogen gas and gaseous hydrocarbons is subjected to the above hydroprocessing reactions and the hydrogen gas is reused.

In the naphtha fraction hydrotreating reactor 54, the liquid hydrocarbons of the naphtha fraction supplied from the top of the first fractionator 40 are hydrotreated using hydrogen gas supplied from the hydrogen separator 26 via the wax fraction hydrocracking reactor 50. As a result, the unsaturated hydrocarbons and oxygen-containing compounds such as alcohols contained within the supplied naphtha fraction are converted to saturated hydrocarbons. The product including the hydrotreated liquid hydrocarbons is separated into a gas component and a liquid component in the gas-liquid separator 60. The separated liquid component which is composed of liquid hydrocarbons is transferred into the naphtha stabilizer 72, and the gas component which contains hydrogen gas and gaseous hydrocarbons is reused for the above hydroprocessing reactions.

In the second fractionator 70, the liquid hydrocarbons supplied from the wax fraction hydrocracking reactor 50 and the middle distillate hydrotreating reactor 52 in the manner described above are fractionally distilled into hydrocarbons with a carbon number of 10 or less (with boiling points lower than approximately 150° C.), a kerosene fraction (with a boiling point of approximately 150 to 250° C.), a gas oil fraction (with a boiling point of approximately 250 to 360° C.) and an uncracked wax fraction (with a boiling point exceeding approximately 360° C.) that has not undergone sufficient cracking within the wax fraction hydrocracking reactor 50. Specifically, the uncracked wax fraction is discharged from the bottom of the second fractionator 70, the gas oil fraction is discharged from the lower section of the second fractionator 70, the kerosene fraction is discharged from the middle section, and hydrocarbons with a carbon number of 10 or less are discharged from the top of the second fractionator 70 and supplied to the naphtha stabilizer 72.

In the naphtha stabilizer 72, the hydrocarbons with a carbon number of 10 or less supplied from the naphtha fraction hydrotreating reactor 54 and the second fractionator 70 are distilled, and naphtha (having a carbon number of 5 to 10) is obtained as a product. Accordingly, high-purity naphtha is extracted from the bottom of the naphtha stabilizer 72. Meanwhile, a flare gas including mainly hydrocarbons with a carbon number of 4 or less, namely hydrocarbons other than the targeted product, is discharged from the top of the naphtha stabilizer 72. This flare gas is transferred to an external combustion facility (not shown in the drawings), where it is combusted and then discharged into the atmosphere.

In the process for producing hydrocarbons of the embodiment described above, the first flow rate regulating valve 95 and the second flow rate regulating valve 97 are not adjusted on the basis of the respective heights of the liquid surfaces within the first buffer tank 91 and the second buffer tank 92, but are rather adjusted so that the production rates for the light hydrocarbon oil and the heavy hydrocarbon oil that have been estimated on the basis of the set reaction temperature of the FT synthesis reaction are equal to the discharge flow rates for the light hydrocarbon oil from the first buffer tank 91 and the heavy hydrocarbon oil from the second buffer tank 92 respectively. With this type of flow rate control, if a temporary divergence in the reaction temperature from the set value or a fluctuation in the height of the slurry liquid surface occurs during the FT synthesis reaction, then because the fluctuation is moderated by the first buffer tank 91 and the second buffer tank 92, significant fluctuations are unlikely to occur in the proportions and flow rates of the light hydrocarbon oil and heavy hydrocarbon oil supplied to the first fractionator 40. Accordingly, even if a temporary divergence in the reaction temperature from the set value or a fluctuation in the height of the slurry liquid surface occurs during the FT synthesis reaction, fluctuations in the composition and flow rate of the mixed oil supplied to the first fractionator 40 can be suppressed, enabling the operation of the first fractionator 40 to be stabilized.

While the process for producing hydrocarbons of the present invention has been described above on the basis of a preferred embodiment, the present invention is in no way limited by the embodiment described above, and various modifications can be made without departing from the scope of the present invention.

For example, in the embodiment described above, the FT synthesis reaction is executed in a bubble column slurry bed reactor, but a fixed bed reactor may also be used. In such a case, the gas-liquid separation step for the reaction product is conducted using a gas-liquid separator provided downstream from the reactor.

Further, in the embodiment described above, the control unit 98 was provided for adjusting the first flow rate regulating valve 95 and the second flow rate regulating valve 97, thereby controlling the discharge flow rates of the light hydrocarbon oil and the heavy hydrocarbon oil, but the control unit 98 may not necessarily be provided, and in such cases, an operator can calculate estimated values of the production rates of the light hydrocarbon oil and the heavy hydrocarbon oil based on the set reaction temperature for the synthesis step, and then based on these estimated values, manually adjust the first flow rate regulating valve 95 and the second flow rate regulating valve 97.

Further, in the embodiment described above, in the fractional distillation step, the fractional distillation was performed so as to yield three fractions, namely a wax fraction, a middle distillate and a naphtha fraction, but fractional distillation may also be performed so as to yield two fractions, namely a wax fraction and a light hydrocarbon fraction containing the hydrocarbons other than the wax fraction. In such a case, in the upgrading step, fractionation is conducted by hydrocracking the wax fraction and hydrotreating the light hydrocarbon fraction.

Furthermore, in the embodiment described above, the fractional distillation in the second fractionator 70 was performed so as to yield four fractions, namely hydrocarbons with a carbon number of 10 or less, a kerosene fraction, a gas oil fraction and an uncracked wax fraction, but the fractional distillation may also be performed so as to yield three fractions, with the kerosene fraction and gas oil fraction combined to form a middle distillate.

DESCRIPTION OF THE REFERENCE SIGNS

30: FT synthesis reactor
40: First fractionator
80: Reactor main unit
91: First buffer tank

92: Second buffer tank
95: First flow rate regulating valve
97: Second flow rate regulating valve
98: Control unit

The invention claimed is:

1. A process for producing hydrocarbons, said process comprising:

a synthesis step of synthesizing hydrocarbons from continuously supplied hydrogen gas and carbon monoxide gas by a Fischer-Tropsch synthesis reaction in presence of a catalyst, a gas-liquid separation step of separating said hydrocarbons into light hydrocarbons and a heavy hydrocarbon oil by gas-liquid separation, a temporary storage step of continuously supplying a light hydrocarbon oil obtained from said light hydrocarbons and said heavy hydrocarbon oil to respective buffer tanks, a discharge step of continuously discharging said light hydrocarbon oil and said heavy hydrocarbon oil respectively from said respective buffer tanks, mixing said light hydrocarbon oil and said heavy hydrocarbon oil, and supplying a resulting mixed oil to a fractionator, and a fractional distillation step of fractionally distilling said mixed oil of said light hydrocarbon oil and said heavy hydrocarbon oil into at least a wax fraction and a fraction that is lighter than said wax fraction, wherein estimated production rates for said light hydrocarbon oil and said heavy hydrocarbon oil are respectively determined based on a set reaction temperature in said synthesis step, and discharge flow rates for said light hydrocarbon oil and said heavy hydrocarbon oil in said discharge step are respectively controlled so as to be equal to said respective estimated production rates.

2. The process for producing hydrocarbons according to claim 1, wherein said synthesis step and said gas-liquid separation step are performed inside a slurry bed reactor having a gas phase portion within an upper section thereof.

3. The process for producing hydrocarbons according to claim 1 or 2, wherein said estimated production rates for said light hydrocarbon oil and said heavy hydrocarbon oil are respectively determined based on a relationship between a reaction temperature of said Fischer-Tropsch synthesis reaction and a chain growth probability for said catalyst used in said synthesis step.

* * * * *